United States Patent [19]

Peter, III et al.

[11] 4,454,419

[45] Jun. 12, 1984

[54] PHOTO-OPTICAL SNAP-ON PAPER PATH SENSOR

[75] Inventors: Emmett B. Peter, III, Orlando; Michael K. O'Brien, Melbourne, both of Fla.

[73] Assignee: Burroughs Corporation, Detroit, Mich.

[21] Appl. No.: 370,398

[22] Filed: Apr. 21, 1982

[51] Int. Cl.[3] ..... H01J 5/02

[52] U.S. Cl. ..... 250/239; 250/223 R

[58] Field of Search ..... 250/239, 571, 560, 561, 250/231 SE, 222.2, 223 R, 569; 235/454

[56] References Cited

U.S. PATENT DOCUMENTS 3,906,240 9/1975 Jeffree ..... 250/239 X

*Primary Examiner*—David C. Nelms
*Assistant Examiner*—Edward P. Westin
*Attorney, Agent, or Firm*—Carl Fissell, Jr.; Edmund M. Chung; Kevin R. Peterson

[57] ABSTRACT

A snap-on unitary, one piece photo-optical item position sensor fabricated as a clothes-pin-like plastic member from a material which is substantially transparent to infra-red radiation obviating lenses. The sensor member is bifurcated at one end to form two parallel leg portions the outboard end of each one of which carries one element of the photo-optical sensing apparatus. The opposite end of the sensor member is rectangularly shaped and slotted on opposite parallel sides forming a polarized receptacle for a mating polarized plug as well as a handle for griping. Compression of the handle portion contacts the slotted end slightly while opening or spreading the two parallel leg portions enabling the sensor to be snapped over an orthogonally disposed item guide or track. Oppositely disposed parallel members on the lower portion of the track automatically position the sensor over the track. A notch in the lower track permits the optical sensing apparatus to be axially aligned perpendicular to the item guide/track.

8 Claims, 7 Drawing Figures

PHOTO-OPTICAL SNAP-ON PAPER PATH SENSOR

BACKGROUND OF THE INVENTION

1. Field of the Invention

The present invention relates to automatic position sensing devices and more specifically to photo-optical sensing apparatus for sensing the presence or absence of an object for example paper items along a defined pathway.

2. Description of the Prior Art

Sensing devices to sense the position or movement of items along a confined pathway are well known in the art. Such devices are to be found for example in printing apparatus, copying apparatus, paper handling devices and in both liquid and gaseous transfer devices.

Many such pieces of equipment utilize mechanical micro switches. These low torque or low activation force micro switches employ spring fingers located usually in the item pathway. However, often times they are too delicate for the harsh environment within which they are employed and are susceptible to damage due to bending, breaking and flexure beyond the capacity of the metal or plastic to recover. Also, the mechanical sensitivity of such low torque switches is relatively low.

Two basic types of optical switches are known and such switches are useful in a variety of situations where mechanical switches do not work successfully or adequately or where it is desirable to avoid moving parts i.e. spring fingers, etc.

1. Reflective optical switch—Reflects light back off of an item to the light source and receptor.

2. Transparent optical switch—Attempts to transmit light through the item.

Although the reflective type switch is used it has a propensity for producing false indications or results. If, for example, colored paper is being employed or paper is used which has already been printed upon in black for example, a black square, the sensor will often produce a false trigger on the reflective mode. The sensor acts as if it sees the opposite side wall of the reflective surface, which breaks the beam being produced and indicates a false position. Additionally, many if not most of this type switch sensor require mounting brackets since none are self supporting.

Another problem associated with mechanical arm or finger wiping type switch sensors is that of the accumulation of debris or dust due to the wiping contact made by the fingers against the items. This induces false readings or signals or in some instances obliterates or surpresses the signal altogether.

All such mechanical switch sensors require a certain amount of adjustment either at the time of assembly and/or during the course of utilization. Cleaning and replacement also tend to require adjustment since the movement often quite naturally displaces the sensor relative to the item pathway however slightly.

It is an important object therefore, of the present invention to overcome these and other associated problems in a new, novel, unobvious and heretofore unknown manner by the provision of a clothes-pin-like snap-on optical sensor.

Another important object of the present invention is the provision of a snap-on sensor that is self locating and requires no adjustment once it is mounted.

It is also an object of the invention to provide an optical sensor that requires no attachment or fastening means since it is self fastening.

A still further object of the present invention is the provision of lateral edge guiding means effective to eliminate a need for horizontal lateral adjustment.

Another object is the provision of automatic locking of the sensor in place once the associated electrical harness has been attached effective to prevent accidental removal or withdrawal.

An important object is to provide an optical sensor that is relatively immune to dirt, dust and other contaminants thus eliminating the need for continual cleaning and refurbishing during extended use.

SUMMARY OF THE INVENTION

The present invention comrpises a clothes-pin-like snap-on T-shaped optical sensor member, the vertical leg of the T being bifurcated to form two substantially parallel, elongated members, the terminal ends of each one of which are angled or tapered inwardly toward each other forming a slight air gap therebetween and mounting a light generator in one member and a light receptor member in the other member with an undercut portion extending backwardly away from the ends forming an aperture therebetween. The crossbar of the T provides a stop or limit as well as an attachment tang useful where necessary or required for those unsual mounting situations not generally encountered. A bifurcated, box-like portion extends backwardly away from the crossbar of the T and is slotted on opposite sides to form a polarized receptacle for receiving a mating polarized plug provided with two oppositely disposed dissimilar size parallel projections which mate with the receptacle slots in only one orientation effectively preventing accidental misalignment or damage to the electrical portion of the assembly.

The structural arrangement of the present invention is such that the device is both self aligning, self adjusting and self wiping and is automatically locked in place once mounted to the area being sensed or monitored and with the polarized plug firmly attached thereto.

An important aspect of the present invention is that the optical sensing mechanism of the present device is completely "self adjusting" and this is a result of the fact that the sensor is securely mounted and locked directly on the item pathway or track at the precise, predetermined point in the pathway it is to accurately monitor. Thus, since the sensor assembly once mounted and locked in position cannot move either vertically or laterally - no adjustment is required.

Also, since the sensor assembly is a "snap-on" mechanism no mounting devices or hardware are required and this is so even though, as illustrated, mounting holes are provided in the assembly. The mounting holes shown form no part of the invention but are provided for those placement conditions where no track or pathway arrangement is used, such for example, as where the optical sensor is to be employed with a rotatable timing disk for timing the operation of associate apparatus. In this case since the sensor cannot be snapped over the disk edge the mounting holes are employed to fixedly position the sensing unit relative to the disk.

The present sensing assembly is self aligning by virture of the edge guides which are formed on opposite sides of the notched item pathway or track. This feature maintains the horizontal or lateral position fixed relative to the pathway and the vertically oriented sensing elements of the sensor.

Another important feature of the present invention is that the snap-on assembly provides a built-in or integral handle by way of the connector portion of the device. In use the connector elements are simply squeezed by hand which automatically spreads open the forward optical sensor carrying ends enabling the assembly to be snapped over the operably associated item track. Release of the finger pressure against the connector ends quickly snaps the sensor end off of the track. Insertion of the mating plug connector into the polarized mating opening in the connector end locks the sensor into position on the track.

From the foregoing it should be readily apparent that the present invention comprises a one piece, unitary assembly which is relatively simple to mold, form and fabricate and which requires no tools or other assembly or mounting attachments or devices for use with its operably associated apparatus.

DESCRIPTION OF A PREFERRED EMBODIMENT

In the environment of a printer/copier apparatus, for example, in which sheet items are moved at relatively high speed it is necessary and required that each item be located "at" some predetermined position during the course of the progression of each item from an input area or station e.g. input item hopper, to an output area or station e.g. output item hopper. This location or position sensing requirement has to do with timing as it relates to jam detection, misfeeding, overlapping of items, non feeding of items and general clock timing for the usual software employed by the printer/copier apparatus.

Figure 1:
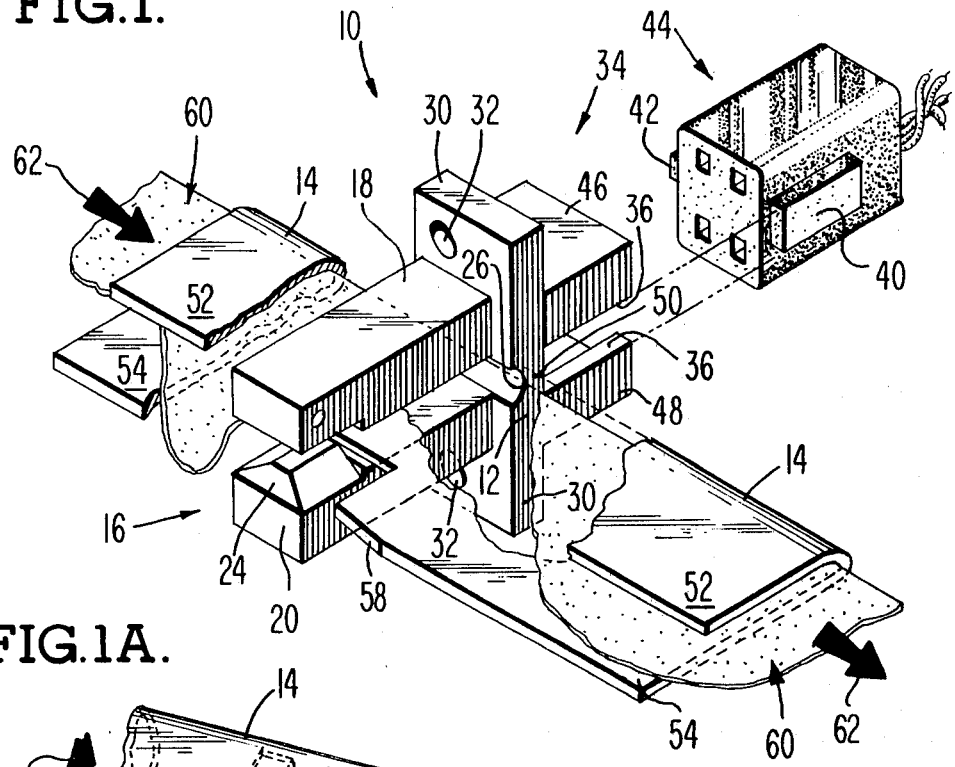
FIG. 1 is an isometric view of a snap-on photo-optical sensor in accordance with the present invention.

The present invention is seen in FIG. 1 of the drawings to comprise a unitary, single piece, molded, cast or otherwise formed assembly 10 which, as shown, partakes, for the sake of description, of a T-shaped plastic member 12 (illustrated in isometric on its side). Member 12 is fabricated from material which is substantially transparent to infra-red radiation, as will appear more clearly hereinafter. Since a major portion of member 12 is adapted to overlie the item pathway or track 14 the longer end portion 16 of the T is bifurcated to form two parallel legs 18 and 20, terminating in an upper and a lower angular crown 22 and 24 (FIG. 4), respectively. Only the lower crown 24 being seen in FIGS. 1 and 2. The inboard end (right in FIG. 1) is radially cut, milled or molded, as at 26, for purposes to be explained shortly herein. The crossbar 50 of the T includes two oppositely disposed, integral (vertical) tangs 30 each of which is provided with an aperture 32 therein. These apertures are not generally required or utilized but may serve a useful purpose, as will be seen later on herein.

Extending away from the crossbar of the T formation and in axial alignment therewith is a box-like projection 34 forming an electrical receptacle (female). Opposite side walls of member 34 include separate polarizing slots 36 and 38, which as seen most clearly in FIG. 1 receive the mating polarizing projections 40 and 42 of an electrical connecting plug 44 (male), for purposes to become clear shortly herein.

The present apparatus is self supporting, self aligning and self cleaning, as will now be described. In fabrication, as earlier mentioned, the assembly 10 is constructed of a plastic material which is substantially transparent to infra-red light. This obviates the need for lenses which in turn obviates the requirement for periodic cleaning of the active area of the assembly, as will become more apparent shortly.

Figure 2:
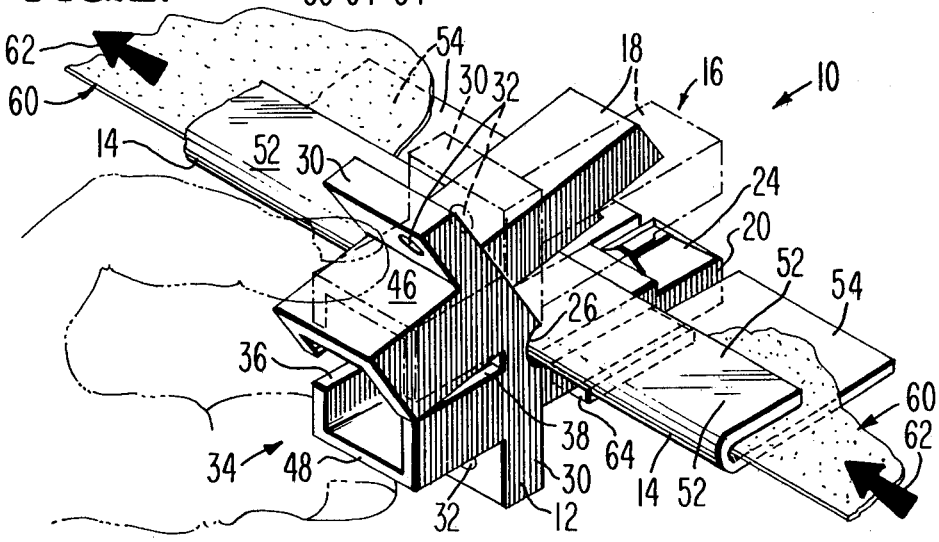
FIG. 2 is an isometric view of the device of FIG. 1 from the opposite end illustrating the polarized receptacle and "snap-on" action.
Figure 3:
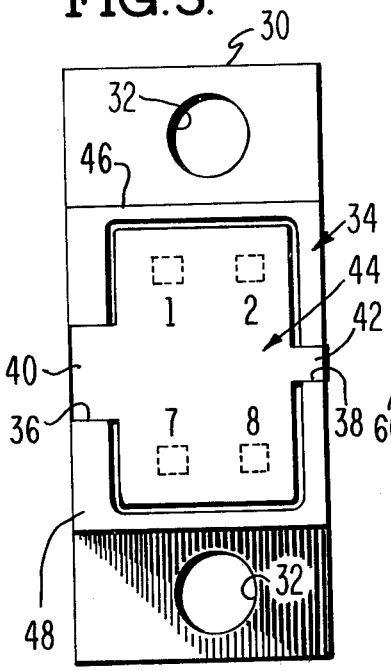
FIG. 3 is a greatly enlarged view (not to scale) of the device of FIG. 1 showing the plug mated with the receptacle.

As seen most clearly in FIG. 2 in attaching the sensor assembly 10 to the item pathway or track 14 the user merely squeezes the two confronting upper and lower portions 46 and 48 of the box-like receptacle 34 together which in turn concurrently separates the elongated parallel legs 18 and 20 (dotted outline). Because the vertical root portion 50 between the receptacle 34 and the legs 18 and 20 is relatively narrow or thin the plastic material bends slightly but sufficiently to permit the leg portions to snap over the track 14.

Figure 1A:
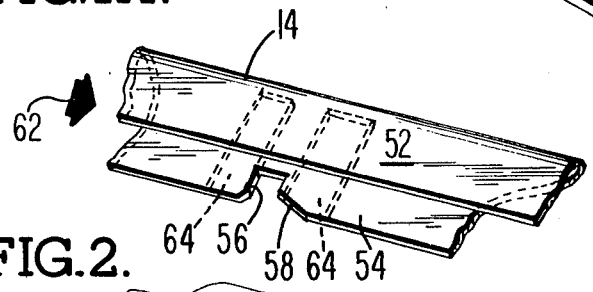
FIG. 1*a* is a partial top plan view of the item document track pathway illustrating the sensor notch and lateral guides.

Track 14 is substantially U-shaped as seen in FIGS. 1, 1*a* and 2 with the shorter upper flat wall 52 terminating over the longer lower flat wall 54 a short distance equivalent to the front to back depth of the upper angular crown member 22. The lower wall member 54 is notched as at 56 (FIG. 1*a*) so as to fit snugly around the crown 24. An angular cut out, chamfer or bevel 58 is provided in wall 54 so as to prevent item hang up or interference during passage of items 60 along the track pathway in the direction of arrow 62.

Secured to the lower wall 54 of track 14 as by spot welding, soldering, etc. are two rigid strips 64—64 aligned with the lower leg 20 and adapted to straddle the leg 20 when assembly 10 is snap-mounted over track 14. By this means lateral stability and alignment is automatically assured while alignment tools and routines normally employed are completely eliminated. The "fit" between the assembly 10 and track 14 is such that there is no displacement either vertically or horizontally once the sensor is snapped in place over the track 14. A rigid lateral edge guide for items 62 is thus provided and locked in place with the attachment of the plug member.

Figure 4:
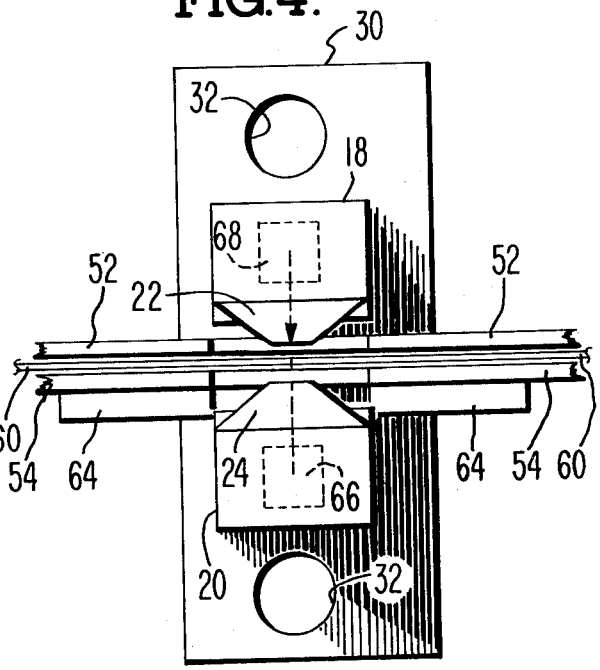
FIG. 4 is a front elevational view of the invention illustrated in position on an item pathway track.
Figure 5:
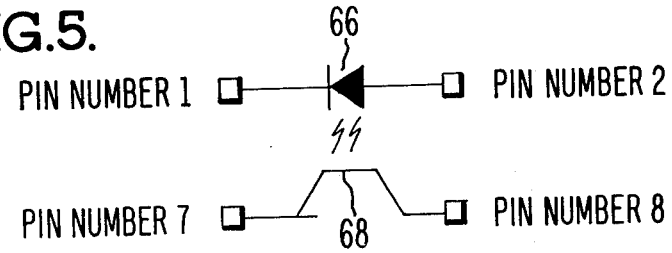
FIG. 5 is a schematic diagram of the electrical circuit used with the device as illustrated herein.

A photo-optical infra-red generator or transmitting device 66 manufactured by Optron Inc., a division of TRW Inc., is molded or potted into the lower crown member 24. An infra-red receiver or detector member 68 is molded or potted into the upper crown member 22. Members 66 and 68 are axially aligned as seen in FIG. 4 and since the plastic material, polysulfon, is transparent to IR light no lens or other structure need be used with the present arrangement. The simple electrical circuit for the sensor is shown in FIG. 5 with the electrical plug receptacle pins number 1, 2, 7 and 8 (the other intermediate pin contact locations are not used).

When employed as designed the sensor 10 requires no mounting means since it is a snap-on device which overlies the item transport track much like a clothes pin snaps over a clothes line. It is self supporting once clamped over the tack.

Figure 6:
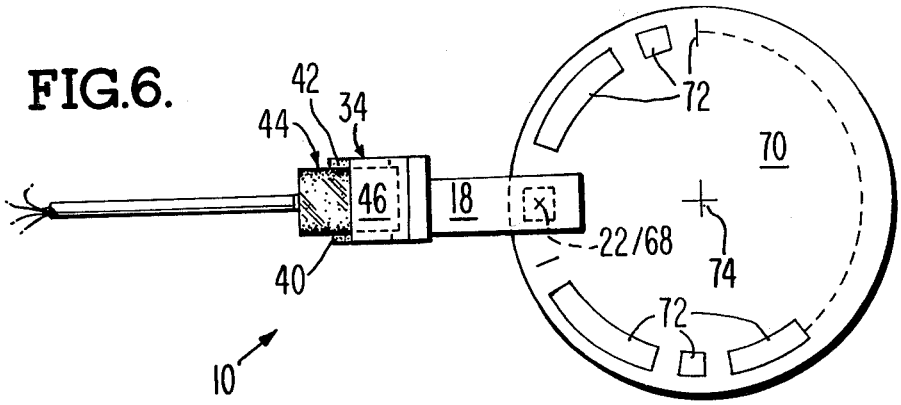
FIG. 6 is a schematic view (not to scale) of a timing disk arrange utilizing the present invention.

However, the present invention lends itself admirably well and efficiently to those applications where no track is available. For example, in certain apparatus wherein a timing device is required the subject sensor 10 can be employed to provide timing without changing the structural arrangement of the device. As seen in FIG. 6 a timing disk 70 having timing marks or slits 72 disposed around the periphery thereof is mounted for rotation on shaft 74 by means not shown. The legs 18 and 20 (only leg 18 being shown) straddle disk 70 with the active crown portions 22 and 24 (only crown 22 being shown) actually aligned so as to pass the IR beam across the air gap therebetween. With disk 70 interposed in the gap, rotation thereof breaks the IR beam generating a signal in timed relation to the passage of the disk marks or slots 72. The mounting holes 32—32 are in this case used to physically locate and securely position the sensor 10 relative to the disk 70.

There has thus been described a novel optical sensor which as described and claimed requires no mounting or attachment means since it is a snap-on device. The sensor when in use is self cleaning due to the relatively small item air gap between the two active optical areas. No lenses are required since the polysulfon material is transparent to infra-red radiation and thus the beam from the generator to the receptor is a straight through pathway.

The sensor is self adjusting and automatically self aligning since once it is snapped over the edge guide track the vertical and horizontal positioning is fixed. The size and shape of the subject sensor permits it to be used in exceptionally small and cramped space because no mounting means is required. The handle portions of the device act as a connector which when compressed open the longer leg portions for snap-on attachment to the item guide track. Once in place the plug connector is inserted in the connector handle to lock the sensor against accidental dislodgement or removal from the device with which it is being employed.

What is claimed is:

1. A snap-on photo-optical item position sensor comprising:

a unitary, semi-rigid, slightly flexible member having oppositely disposed elongated parallel leg portions;

the terminal end of each of said leg portions including photo-optical means for sensing the passage therebetween of a moving item;

the opposite end of said semi-rigid yet flexible member being provided with an open, rectangular receptacle including oppositely disposed parallel slots to receive a plug member for applying electrical potential to said photo-optical means for sensing items;

the area of said semi-rigid member intermediate the leg portions and said receptacle being undercut sufficiently so as to permit the parallel leg portions to be slightly separated upon application of pressure to opposite sides of the slotted receptacle enabling the semi-rigid member to be received and snapped over an item pathway or track.

2. The invention in accordance with claim 1 wherein said semi-rigid unitary member is fabricated from material which is substantially transparent to infrared light.

3. The invention in accordance with claim 1 wherein said item pathway or track is provided with a notch in its lower surface permitting said sensor to be positioned thereover in relatively tight fit.

4. The invention in accordance with claim 1 wherein said track includes oppositely disposed parallel members straddling said notch effective to prevent lateral, horizontal displacement of said sensor.

5. The invention in accordance with claim 1 wherein said receptacle is provided with oppositely disposed parallel, disproportionately sized slots effectively forming a polarized opening therein.

6. The invention in accordance with claim 1 further including a polarized plug receivable in said receptacle and wherein said plug includes integral external parallel projections engageable with said slots to secure said plug within said receptacle.

7. The invention in accordance with claim 1 wherein the terminal end of each of said leg portions includes a respective crown portion and wherein the photo-optical sensing means is disposed within a respective crown portion with the two sensing means in axial alignment.

8. The invention in accordance with claim 1 wherein the upper portion of the track is undercut so that the lower portion thereof extends beyond the upper portion, with the upper portion terminating adjacent to the inboard edge of the lower crown portion.

* * * * *